United States Patent [19]

Terzian

[11] 4,312,150

[45] Jan. 26, 1982

[54] ANIMATED DOLL

[75] Inventor: Rouben T. Terzian, Chicago, Ill.

[73] Assignee: Marvin Glass & Associates, Chicago, Ill.

[21] Appl. No.: 10,940

[22] Filed: Feb. 9, 1979

[51] Int. Cl.[3] ..... A63H 11/00

[52] U.S. Cl. ..... 46/120; 46/265

[58] Field of Search ..... 46/120, 150, 264, 266, 46/119, 265, 130, 131, 132, 133, 134, 149, 268, 126; 3/1, 1.1, 1.2

[56] References Cited

U.S. PATENT DOCUMENTS

| | | | |
|---|---|---|---|
| 156,660 | 11/1874 | Clay | 46/119 |
| 1,609,653 | 12/1926 | Maez | 46/126 |
| 2,747,329 | 5/1956 | Gruenewaelder | 46/126 |
| 2,906,059 | 9/1959 | Berger | 46/268 |
| 3,024,551 | 3/1962 | Oppenheim | 46/126 |
| 3,500,577 | 3/1970 | Bart | 46/134 |
| 3,548,537 | 12/1970 | Robbins | 46/150 |
| 3,568,361 | 3/1971 | Bart et al. | 46/264 |
| 3,568,362 | 3/1971 | Tomaro | 46/234 |
| 3,653,152 | 4/1972 | Levine | 46/120 |
| 3,949,521 | 4/1976 | Heerlein | 46/266 |
| 4,073,088 | 2/1978 | Beny et al. | 46/265 |

FOREIGN PATENT DOCUMENTS

| | | | |
|---|---|---|---|
| 184673 | of 1966 | U.S.S.R. | 46/265 |

*Primary Examiner*—Robert Peshock

*Assistant Examiner*—Michael J. Foycik

*Attorney, Agent, or Firm*—Mason, Kolehmainen, Rathburn & Wyss

[57] ABSTRACT

A doll capable of raising itself in a natural realistic manner from a generally prone position on a supporting surface to either a sitting position or a standing position. The doll includes a pair of legs pivotally mounted on the doll's torso for movement about their respective axes in a timed sequence and a drive mechanism including a motor and a pair of cams which control the timed leg movements. In operation, the doll is placed in a prone face down position on a suitable supporting surface with its legs aligned with the torso in a generally horizontal position. Upon activation of the drive mechanism, one leg is pivoted downwardly approximately 150° to a position generally alongside the torso and then remains in that position while the second leg is brought forward to a position in generally parallel alignment adjacent the opposite side of the torso. Continued energization of the drive mechanism causes the torso to pivot upwardly to a sitting position. The head of the doll is movable between two positions to determine the shutoff time of the drive mechanism. In its forward tilted position, the drive mechanism is shut off when the doll assumes a sitting position. The rearward position of the head permits the drive mechanism to continue to operate until the doll reaches a standing position.

15 Claims, 12 Drawing Figures

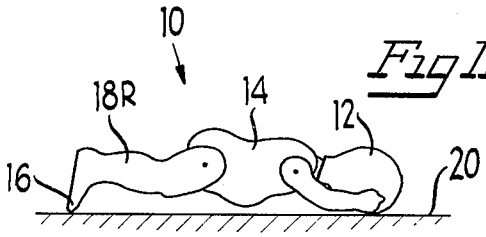
Fig 1A
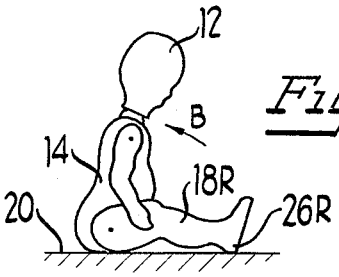
Fig 1D
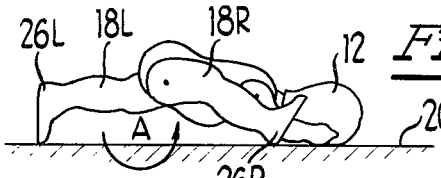
Fig 1B
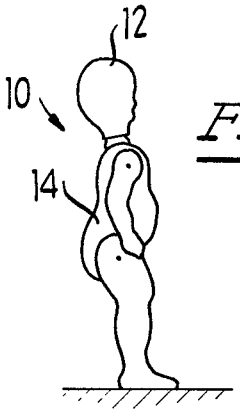
Fig 1E
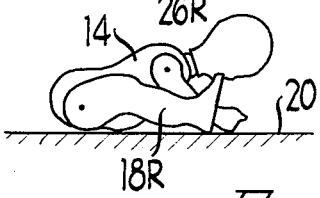
Fig 1C
Fig 2
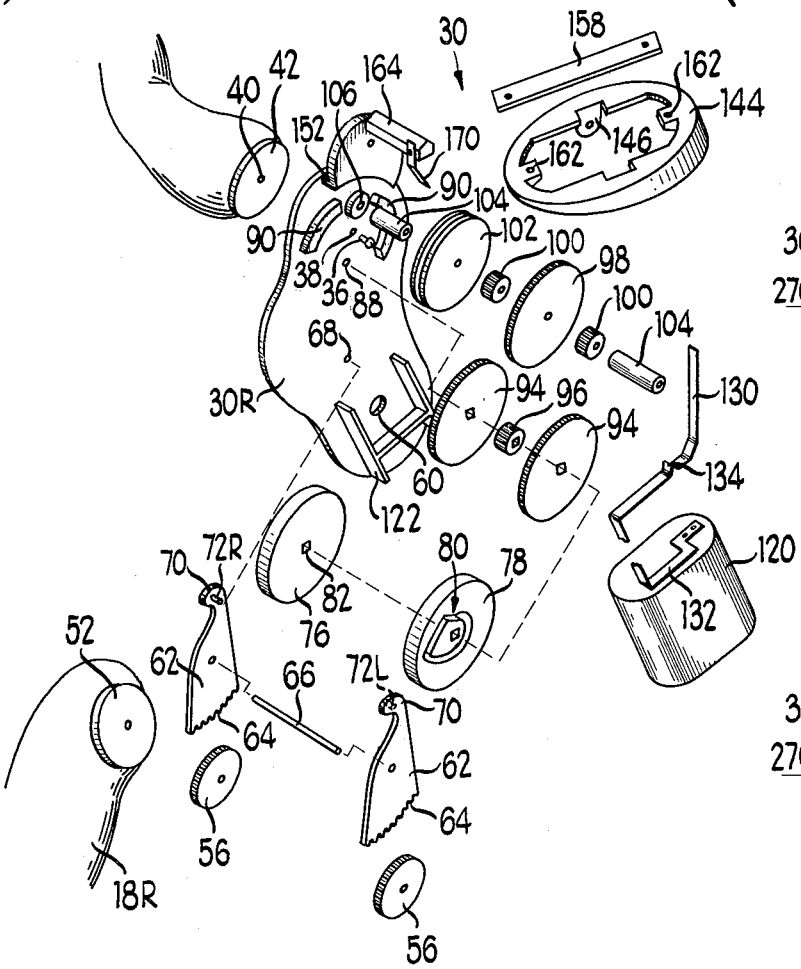
Fig 3
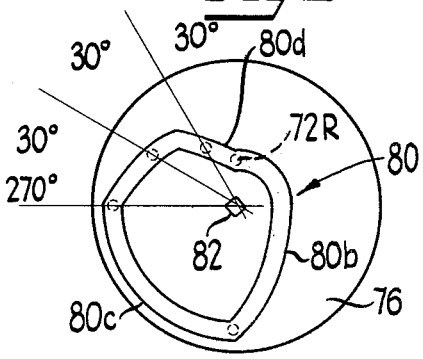
Fig 4
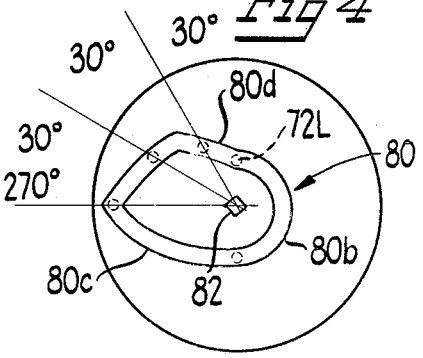

ANIMATED DOLL

BACKGROUND OF THE INVENTION

1. Field of the Invention

This invention relates to mechanical dolls, and in particular to a mechanical doll which is capable of raising itself from a prone position to either a sitting or standing position.

2. Brief Description of the Prior Art

In the past, many mechanical dolls have been proposed of the general type which permit a doll to perform some functions or actions which simulate a child. Typical of these actions are walking, crying, talking and wetting dolls. There are, likewise, a large number of prior art mechanisms for simulating one of the above-described or other actions.

Similarly, mechanisms have been known which are capable of maintaining a doll or figure toy in either a sitting or standing position.

SUMMARY OF THE INVENTION

An object of the present invention is to provide a novel doll which is capable of raising itself from a prone position to a sitting or standing position.

The doll of the present invention incorporates means for raising the doll from a generally prone position on a supporting surface to either a sitting position or a standing position. The doll includes a pair of legs pivotally mounted on the doll's torso for movement about respective axes in a timed sequence. A drive mechanism includes a motor and a pair of cams which control the doll's movements. The head of the doll is movable between two positions to determine the shutoff time of the drive mechanism and, as a consequence, the final position assumed by the doll. In its forward tilted position, the drive mechanism is shut off when the doll assumes a sitting position. The rearward position of the head permits the drive mechanism to continue to operate until the doll reaches a standing position.

In operation, the doll is placed in a prone face down position on a suitable supporting surface having its legs aligned with the torso in a generally horizontal position. Upon activation of the drive mechanism, one leg is pivoted downwardly approximately 150° to a position generally alongside the torso and then remains in that position while the second leg is brought forward to a generally parallel alignment adjacent the opposite side of the torso. Continued energization of the drive mechanism causes the torso to pivot upwardly to a sitting or standing position as determined by the position of the head.

The novel features of the present invention are set forth with particularity in the appended claims and the invention will be best understood from the following description when read in conjunction with the accompanying drawings.

BRIEF DESCRIPTION OF THE DRAWINGS

FIG. 1 shows a side elevational view of a sequence of movements of the doll of the present invention, including:

FIG. 1*a* showing the doll in a fact down, prone position;

FIG. 1*b* showing the doll after one leg has been rotated approximately 150° in a counterclockwise direction;

FIG. 1*c* showing the doll in a crouched position after the other leg has rotated approximately 150°;

FIG. 1*d* showing the doll after it has assumed its sitting position;

FIG. 1*e* showing the doll after it has assumed its standing position;

FIG. 2 is an exploded, fragmentary perspective view, on an enlarged scale, showing the drive mechanism of the doll of the present invention;

FIG. 3 is a side elevational view, on an enlarged scale, of the cam which drives the right leg through its movement;

FIG. 4 is a similar view of the left cam which drives the left leg through its series of movements;

DESCRIPTION OF THE PREFERRED EMBODIMENT

Figure 5:
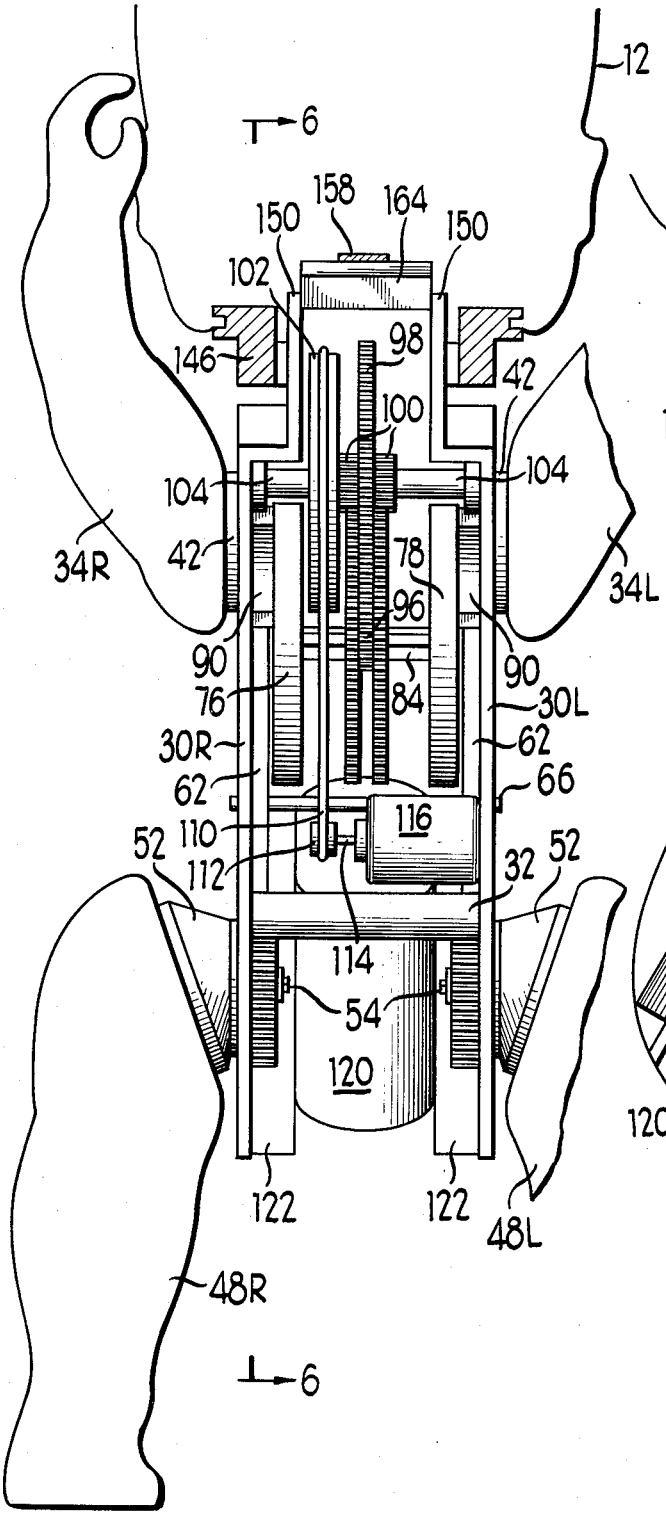
FIG. 5 is a front elevational view of the doll of the present invention with the torso shell removed.

A doll made in accordance with the concepts of the present invention is shown in FIG. 1, and generally designated by the reference numeral 10. FIG. 1 shows five sequential views 1*a*–1*e* showing the doll 10 in various positions in its sequence of movements. For a better understanding of the operation of the doll, reference is made to the separate views of FIG. 1. FIG. 1*a* shows the doll 10 in its initial, prone position with the forehead portion of its head 12, the front portion of its torso 14 and the toes 16 of the legs 18 against a suitable support surface 20. FIG. 1*b* shows the doll 10 after the drive means 24 (FIG. 2) has pivoted the right leg 18R through an arc of approximately 180° such that the right heel 26R is in engagement with the support surface 20. This movement results in a pivoting of the torso about a longitudinal axis, generally through the point of contact of the head on the left foot to raise the body for clearance of the right leg. The drive means 24 then permits the right leg 18R to dwell in that position while the left leg 18L is pivoted through a similar arc in the direction of arrow A until the heel 26L engages the support surface. The travel of the legs 18R and 18L is slightly less than 180° since, as shown in FIG. 1*c*, the torso 14 is raised to an angle of approximately 25° with respect to the support surface 20.

Continued energization of the drive means 24 causes both legs 18L and 18R to pivot in a clockwise or opposite direction relative to the torso 14. However, since the heels 26 are in engagement with the support surface 20, the torso portion 14 is pivoted upwardly in the direction of arrow B to a sitting position as shown in FIG. 1*d*. The head 12 is movable with respect to the torso between two positions, shown in FIG. 1*d* with the head nodded or tilted forward relative to the torso 14 and FIG. 1*e* with the head tilted or nodded backward with respect to the torso 14. In its forward position, as shown in FIG. 1*d*, the head is connected to a switch means generally designated 30 (FIG. 2) which terminates energization of the drive means 24 at a first point causing the doll to assume a sitting position. However, in its rearwardly tilted position, the head 12 presets the switch means 30 so that the drive means 24 continues to rotate past the prior stop point to move the legs relative to the torso 14, to a generally vertical orientation. The change in the weight distribution, by moving the head, causes the doll to pivot about the heels 26 from FIG. 1*c* directly to FIG. 1*e*. The sequences of FIGS. 1*a*–1*d* show the doll moving from the prone position to the sitting position of FIG. 1*d*. When the head is preset in the position as shown in FIG. 1*e*, it would be tilted upwardly or rearwardly in FIG. 1*c* and thereby move directly to FIG. 1*e*.

Figure 6:
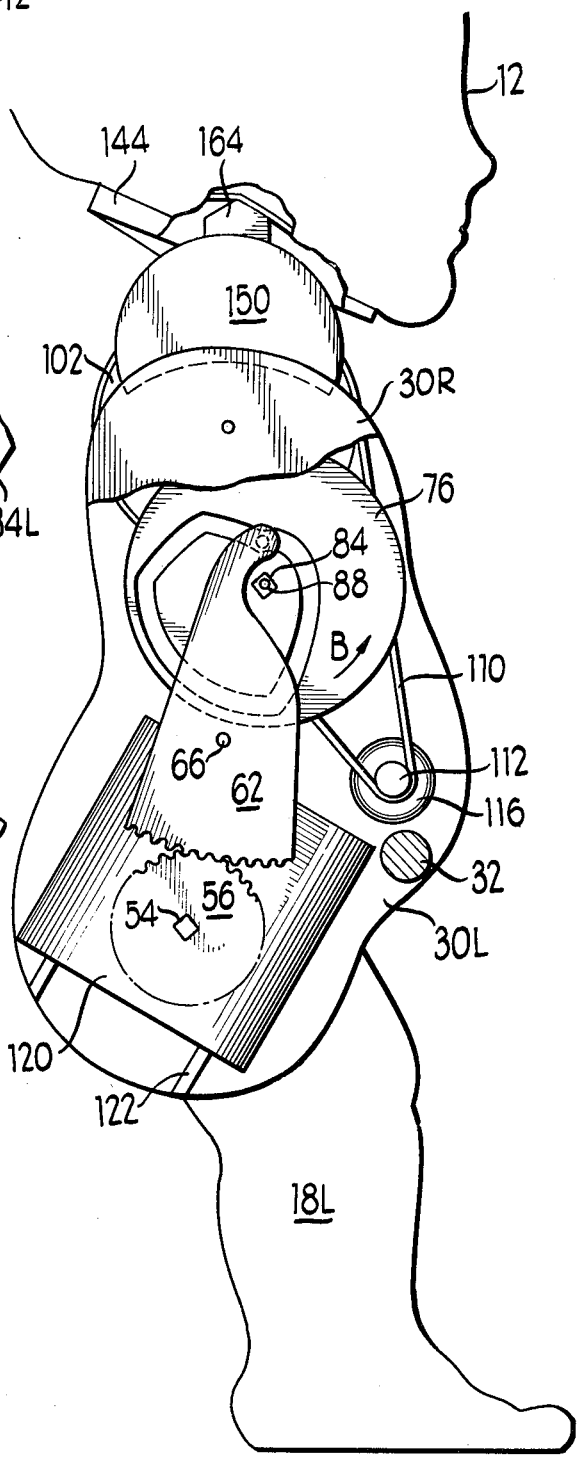
FIG. 6 is a vertical section taken generally along line 6—6 of FIG. 5.
Figure 7:
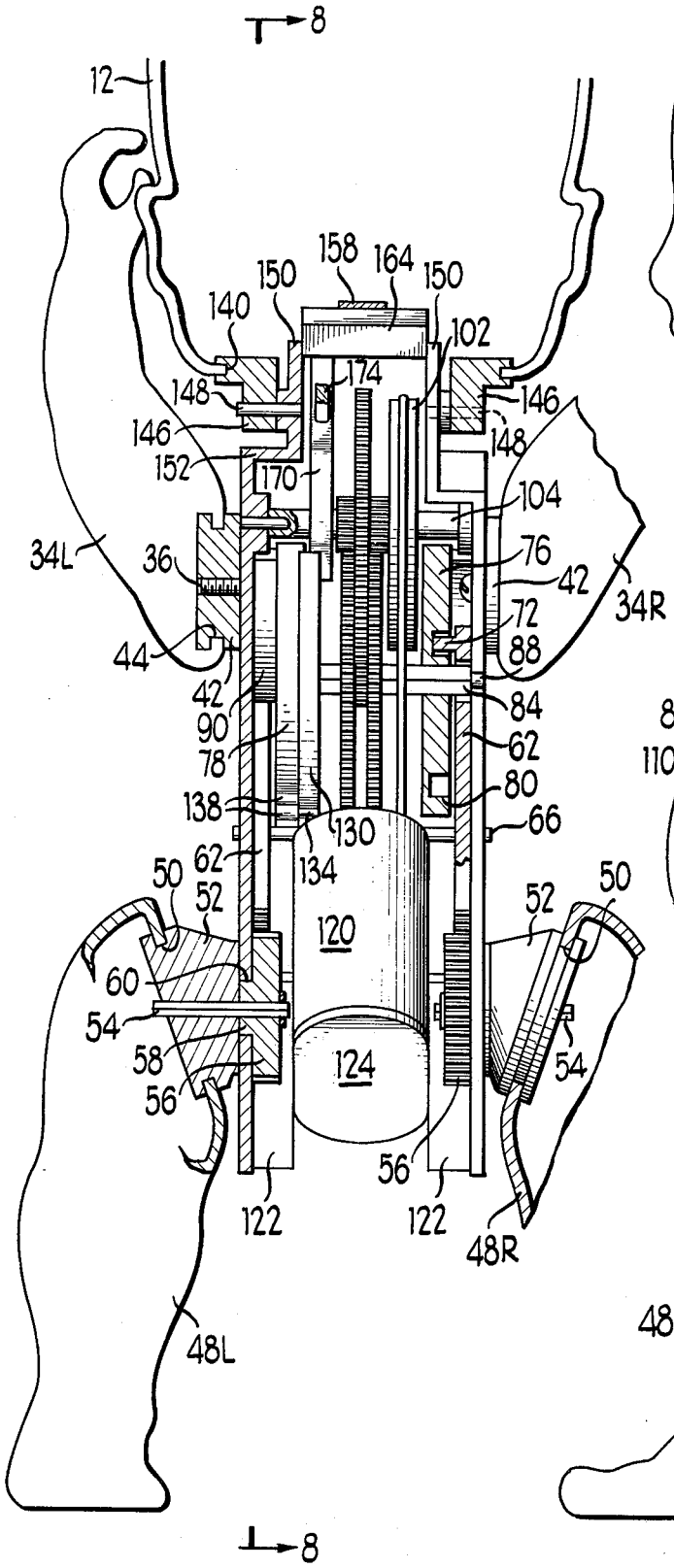
FIG. 7 is a rear elevational view, on an enlarged scale, of the doll of the present invention with the torso shell.

The drive means 24 includes a compact gear train formed within the doll torso as shown in FIGS. 5–8. For simplicity, and ease of understanding, the drawings 2–8 show the doll contemplated by the present invention with its torso shell 14 removed to expose all of the gears and other elements of the drive means 24. Referring more particularly to FIGS. 2–8, the doll includes a pair of side plates 30R and 30L which provide a main housing or frame for the drive means. A plurality of connecting rods such as the rod 32 are secured between the plates to maintain the plates 30 in a generally parallel orientation with respect to one another and to rigidly provide a support for the drive means. A pair of arms 34R and 34L are pivotally mounted at the uppermost portion of the plates by means of a screw 36 through an aperture 38 in the side wall and a threaded aperture 40 in an end cover spool 42. In FIG. 7, a cross section of one of the spools 42 reveals that the arm 34L is secured to the spool 42 within a groove 44 which permits the arm to be frictionally adjusted relative to the spool 42.

Referring again to FIGS. 7 and 5, the pair of legs 48R and 48L are mounted in similar grooves 50 on a pair of leg mounting spools 52. However, since the legs are driven, the leg mounting spools 52 are rigidly fixed to a square shaft 54 to rotate with an inner gear 56 mounted on the shaft 52. A reduced diameter portion 58 of the gear 56 is journalled within a suitably sized aperture 60 in each of the plates 30. The gears 56 thus drive the legs through their motions as described with respect to FIG. 1 above.

In particular, each of the gears 56 is in meshing engagement with an arcuate cam follower plate 62. Each cam follower plate 62 includes a lower arcuate rack section 64 for meshing engagement with the gears 56 and is mounted by a common shaft 66 extending through opposed apertures 68 in the plates 30. Each of the cam follower plates 62 includes an upper cam follower pin mounting portion 70 which carries therewith an inwardly directed pin 72 for following a cam surface.

Cam means in the form of the discs shown in FIGS. 3 and 4 are provided to drive the legs through their predetermined movement. A righthand or lead cam 76 is shown in FIG. 3 and a lefthand or follower cam 78 is shown in FIG. 4. The cams basically include a disc portion of substantial thickness into which a groove, generally designated 80, is milled or otherwise provided. The cam follower pins 72 on each of the plates 62 rides within the groove 80 of its associated cam member 76 or 78, on either the right or left side of the doll, respectively. Each cam 76 and 78 includes a central, square mounting aperture 82 which mount the respective cams on a square shaft 84 (FIGS. 5–8). The square shaft is secured between opposed apertures 88 in the opposed plates 30. A pair of generally arcuate ribs 90 are provided integrally generally at the top of the plates 30 to provide an outer bearing surface for the cams 76 and 78, since the cam pin mounting portion 70 rides between the outside surface of the respective cam 76 or 78 and the side plate 30R or 30L. As can be seen in FIG. 7, the pin 72 extends inwardly into the channel or groove 80 of the cam 76 shown in cross section in FIG. 7. In addition, the square shaft 84 mounts a drive gear assembly, including two large drive gears 94 sandwiching a smaller pinion gear 96. This gear triplet includes a complementary square aperture to engage the shaft 84 and drive the cams 76 and 78 at the same rate of angular rotation. Note that the dotted lines in FIG. 2 indicate that the cam 76 and 78 are mounted on the same axis as the gears 94 and 96 by the square shaft 84 supported between the opposite apertures 88. A second set of gears, generally above the gears 94 and 96, serve as power or drive gears for the square shaft therebelow. In particular, a pinion gear 96 engages a large gear 98 which is generally the same diameter as the gears 94. Similarly, the gears 94 engage a pair of pinion gears 100 which are the same size as the pinion gear 96. The gears 98 and 100 are mounted for conjoint rotation with a pulley 102 and a pair of spacers 104 on a shaft extending between the two plates 30 and journalled within opposed apertures 106 in each side. Thus, rotary power is provided to the cams through the gears 94 mounted on the square shaft 84 and the gears 98 and 100 mounted conjointly with the pulley 102. The pulley 102 is connected by a belt or O-ring 110 to a smaller pulley 112 mounted on the shaft 114 of a motor 116. The motor 116 is mounted, generally in the abdomen area of the torso as shown in FIGS. 5 and 6. Rotation of the motor shaft through the pulley arrangement drives the cam 76 and 78 through one cycle or revolution as the doll moves from the position as shown in FIG. 1*a* to FIG. 1*b* to FIG. 1*c* and then to either FIG. 1*d* or FIG. 1*e* as preselected by the user.

Figure 8:
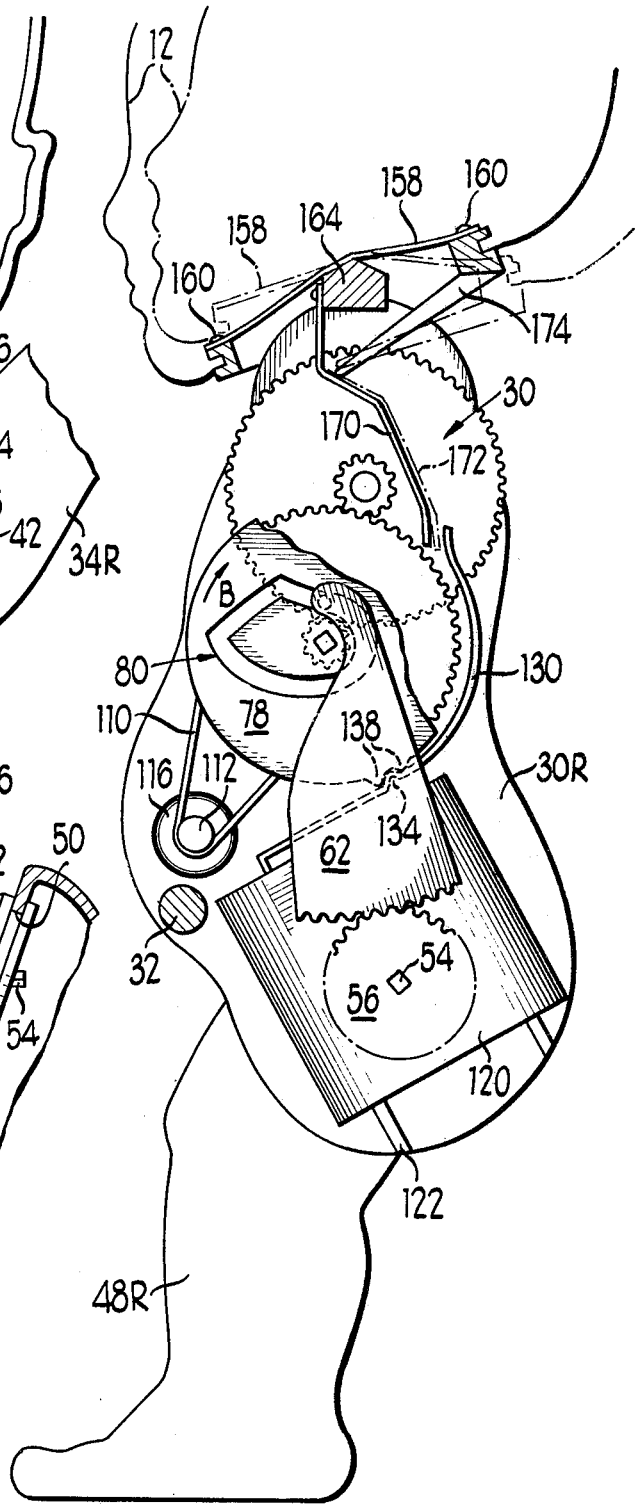
FIG. 8 is a side elevational view taken generally along line 8—8 of FIG. 7.

The motor 116 is energized by a battery pack 120 mounted between the leg mounting shafts 54 as shown in FIGS. 5–8. The battery pack 120 is supported laterally by an H-shaped rib 122 on each of the plates 30. Preferably, a bottom cover 124 is removable to facilitate replacement of a set of batteries which, in the doll of the present invention, serve as a balancing weight for the doll, which will be described in greater detail hereinafter. The switch means 30, referring to FIG. 8, comprises an arcuate contact strip 130 mounted to the top of the battery housing 120, generally offset to the left as shown by the flat strip 132 on the top of the case. This contact strip 130 provides for an automatic shutoff mechanism as described in detail herebelow. The contact strip 130 includes a notch 134 which rides against an inner cam 136 on the inner surface of the drive cam 78. The inner cam includes two notches or teeth as shown in FIGS. 7 and 8 for actuating the switch means 30, the notch 134 is contacted by the teeth 138 at the end of the cycle to terminate energization of the motor.

More particularly, the switch means includes a pivotal mounting of the head 12 as shown in FIGS. 7 and 8. The head 12 is mounted in an arcuate groove 140 formed in the periphery of a head mounting plate 144. The head mounting plate 144 is secured by a pair of depending tabs 146 and pivot pins 148 to a pair of head mounting flanges 150. The head mounting flanges 150 are generally semicircular in shape and mounted inwardly and at the top of the plates 30 by lateral spacers 152. Thus, the head 12 may pivot slightly about the pivot pins 148. A stabilizing strap 158 is secured along the midline of the mounting rim 144 by appropriate connector means such as screws 160 in apertures 162. A stabilizing cam 164, generally in the shape of a roof top, is mounted between the plates 150, at the upper edge thereof, as shown in FIG. 2, to engage the stabilizing flange 158. More particularly, as shown in FIG. 8, the stabilizing flange 158 will engage one or the other of the "roof top" surfaces of the cam 164 and maintain the head 12 of the doll in a preset position.

In the first position, or the sitting position of the head as shown in FIG. 1*d* and in the solid lines of FIG. 8, the band 158 engages the front roof portion of the cam 164 as shown by the solid lines. In the standing position, or the second position of the head as shown in FIG. 1*e* and in phantom in FIG. 8, the band 158 as shown in phantom, engages the back roof portion of the cam 164. Therefore, by virtue of the cam 164 the head is maintained in either the sitting first position or standing second position. Thus, in the two positions the head is oriented to redistribute the weight and center of gravity of the torso which permits movement of the legs to cause the doll to move to either the sitting or standing position.

In addition, the switch means 30 includes a depending contact 170, which is mounted on the front surface of the cam 164, generally in alignment with the arcuate contact 130 to adjust the shutoff time of the motor 116. In particular, when the head is in the sitting position, the solid lines in FIG. 8, a depending finger 174 on the head mounting ring 144 engages the contact 170 and maintains it in the position as shown by the solid lines in FIG. 8. Thus, before the notch 134 of the arcuate contact 130 engages the teeth 138, the contact 130 will be in engagement with the end of the contact 170 at the position shown by the solid lines and designated position "sit". In the alternative or standing mode, when the head is in the position as shown in phantom, the finger 114 does not engage the contact 170, and thus, the contact assumes the position 172 shown in the phantom lines. In this case, the arcuate contact 130 will engage the contact 170 at the position designated "stand". The end result of this switch arrangement presets the contact 170 to either the "sit" or the "stand" position and thus controls the length of time during which the motor is energized. It can be seen, therefore, that when the contact is in the stand position, the motor will be energized for a longer period of time since the contact 130 must be moved through a greater arc in order to disengage a depending contact 170. This difference accounts for approximately 30° in rotation of the cams 76 and 78. After one complete cycle, the contact 130 may be manually depressed into engagement with the contact 170 in order to recycle and thus restart the drive means. The contact 170 is connected to the opposite terminal of the batteries and the contact 130.

The above described mechanism thereby provides the physical and structural elements utilized in the sitting or standing doll of the present invention. The following description of the operation is given with reference to the generally graphic representations of the cam 76 and 78 in FIGS. 3 and 4 with respect to the drawings in FIG. 1. The legs 18R and 18L are driven through the cam follower plates 62 by the gears 76 and 78 respectively. Referring to FIGS. 3 and 4, the position of the cam follower pin 72 within the groove or cam surface 80 is shown in phantom as circles and shown at its various positions which correspond to FIGS. 1*a*–1*e*. In FIG. 1*a*, when the doll is in the prone position, the cam follower pins 72R and 72L are in generally the 10 o'clock position as shown in FIGS. 3 and 4. For simplicity, and to enable the use of the same drawing, the pin is shown in its various positions as moving relative to the schematic cams of FIGS. 3 and 4 while, in reality, the cams rotate relative to the pins which remain at a predetermined radial distance from their mounting shaft 66. When the motor is initially energized, the cams 76 and 78 rotate through an arc of 90° in which the pins 72R and 72L dwell within a radial portion of the respective cam surfaces. However, after the initial 90° of rotation, and through the second or subsequent 90° of rotation of the cam 76, the cam follower pin 72R is moved very rapidly outwardly along the cam segment 80*b* which moves the right leg forwardly. The gear ratio between the arcuate portion 64 of the right cam follower plate 62 is such that the leg pivots forwardly through an arc of approximately 150°. Simultaneously, the corresponding 90° segment of the gear 78 in FIG. 4 is again a radial portion so that the pin 72L again dwells for a 90° period. Thus, in FIG. 1*b*, the position of the legs as shown therein corresponds to the position of the pins 72R and 72L in the respective gears 76 and 78. During the next 90° rotation of the cams, the section 80*c* of the cam slot of cam 76 is a radial portion so that the right leg dwells, and therefore does not move, during the subsequent 90° of rotation. However, referring to FIG. 4, the corresponding 90° includes a cam section 80*c* which is essentially identical to the cam section 80*b* on the cam 76 which causes the left leg to pivot forwardly toward the position as shown in FIG. 1*c*. After the third 90° segment of rotation, the pins 72R and 72L are at the positions designated 1*c* on the respective gears. During the timed movement of the legs 18R and 18L, the torso is permitted to roll, and in fact, rolls significantly about the pivot point determined by the non-moving foot, to permit the leg to swing under the body as shown by the arrow A. Since the legs are generally divergent, slightly outwardly as shown in FIGS. 5 and 7, the body does not have to be raised to a point where it could tip or roll over and therefore, pivots back downwardly to a generally flush position as shown in FIGS. 1*b* and 1*c*.

The doll will move directly from the position as shown in FIG. 1*c* to the position as shown in FIG. 1*e* or 1*d* depending upon the position of the head. For example, referring to FIG. 1*d*, when the head is in the forward sit position, the center of gravity will be generally forwardly and the contact 170 will be in the forward or sit position. Thus, the contact and energization of the motor 116 will be terminated at an earlier point. Specifically, referring to FIGS. 3 and 4, it can be seen that the last quadrant of each cam groove is identical for each of the gears 76 and 78. In other words, the legs move in unison during the last 90° of rotation, and in fact, the top half above the centerline, of each of the cams 76 and 78 are identical and they only differ in the bottom half during initial movement of the legs 18R and 18L. Since the head 12 is in the sit position, the cams will rotate approximately 30° past the 270 position to the position as indicated 1*d* for the pins 72R and 72L, at which point the contact is broken and the motor is de-energized. During this movement of the cams, the legs are blocked by virtue of the engagement of the heels with the floor and therefore continued relative movement causes the torso to pivot upwardly from the position as shown in FIG. 1*c* to the position as shown in FIG. 1*d* where the doll assumes its sitting position. The motor is thus de-energized and the doll remains in the position shown in FIG. 1*e*. To reset the cams, the contact 130 is manually flexed into engagement to drive the cams so that the pins reach the positions designated 1*a*.

When the head is in the stand position, and the motor is permitted to be energized for a longer period of time, the pins 72R and 72L do not stop in the cam position designated 1*d*, but pass right through that position and stop at the position designated 1*e*. Thus, the cam rotates for approximately an additional 30° before the motor is shut down. This movement of the pins results in the doll moving from the position as shown in FIG. 1*c* directly to the position as shown in FIG. 1*e*. Following the movement of the cam follower pins 72R and 72L, it can be seen that during the 30° of rotation between the position as shown in FIG. 1*c* and that represented by the position of the pins at 1*d*, the legs are moved away from the jackknife position of the torso as shown in FIG. 1*c* at a generally linear rate. However, just past the position "1*d*", a discontinuity or sharp bend in the groove causes the pin to rapidly increase in its movement toward the center of the cam so that the leg is rapidly straightened relative to the torso. The combined effect of the head in its rearward or stand position causes the hips or buttocks of the doll to lift upwardly, and to pivot about the heels 72L and 72R of the feet in a generally balanced condition. This balance is achieved by the weight distribution of the gears, batteries, other elements and importantly, the preselected position of the head. When the torso reaches a point in which it forms a right angle with the legs, slightly past the position represented by the pin position "1*d*", the legs are rapidly straightened as the pins move to the position shown at 1*e*. This rapid increase in the movement of the legs produces a small "jerk" which prevents the torso from pivoting down to assume the sitting position of FIG. 1*d* and causes the doll to assume the standing position shown in FIG. 1*e*. The weight distribution cooperates with the shape of the cam groove 80*b*, in its fourth quadrant, along with the period of energization of the motor 116 to determine whether or not the doll will assume the sitting position of FIG. 1*d* or the standing position of FIG. 1*e*.

Many modifications could obviously be made to the doll of the present invention to provide other functions such as walking, crawling or the like. In addition, it would be a simple matter to include interconnections between the arms and the drive means in order to utilize the weight of the arms or movements of the arms to counterbalance movements of the torso or to utilize movements for a crawling effect. Therefore, it should be recognized that the foregoing rather lengthy and detailed description has been given for the clearness and understanding of the present structure only and therefore many modifications will be obvious to those skilled in the art without departing from the spirit and scope of the present invention.

I claim:

1. A doll, comprising:

a doll torso portion;

a pair of legs movably mounted to the torso;

means for moving said legs relative to said torso portion from a first position generally aligned straight outwardly of said torso portion with said doll in a generally prone position, a supporting surface to a second position generally transverse to said torso portion with said doll in a sitting position with said torso portion oriented generally vertically forming a right angle with respect to said supporting surface; and said moving means including a first leg moving means for rotating one of said legs approximately 150° to a position alongside said torso portion, second leg moving means for rotating the other of said legs approximately 150° to a position alongside said torso portion, torso portion moving means for rotating said torso portion approximately 90° from said prone position to a vertically oriented sitting position, and timing means for activating said first leg moving means, said second leg moving means and said torso portion moving means successively in a timed sequence.

2. The doll of claim 1 wherein said torso portion also mounts a head on the top thereof and two arms at the end of the torso adjacent said head.

3. The doll of claim 1 wherein said means for moving said legs further includes second means for moving said doll to a standing position with said torso portion and legs being oriented generally vertically with respect to the supporting surface.

4. The doll of claim 1 or 3 wherein said means comprises a cam means for moving said legs relative to the torso in a predetermined sequence of movement.

5. The doll of claim 4 wherein said cam means includes at least two cams, one associated with each of said legs for moving each leg in a predetermined sequence.

6. The doll of claim 5 wherein each of said cams each include a cam surface causing one of said legs to pivot relative to the torso portion prior to pivoting of said second leg.

7. The doll of claim 6 including drive means for simultaneously rotating said cam means.

8. A doll, comprising:

a doll torso portion;

a pair of legs movably mounted to the torso portion;

means for moving said legs relative to said torso portion from a first position generally aligned straight outwardly of said torso portion with said doll in a generally horizontal position on a supporting surface to a second position generally transverse to said first position with said doll in a standing position with said torso portion and said legs oriented generally vertically with respect to said supporting surface; and said moving means including a first leg moving means for rotating one of said legs approximately 150° to a position alongside said torso portion, second leg moving means for rotating the other of said legs approximately 150° to a position alongside said torso portion, torso portion moving means for rotating said torso portion approximately 180° from said prone position to a vertically oriented standing position, said torso moving means including means for rotating said torso portion and said legs about the point of contact of the free end of said legs with said supporting surface, and timing means for activating said first leg moving means, said second leg moving means and said torso portion moving means successively in a timed sequence.

9. The doll of claim 8 wherein said torso portion also mounts a head on the top thereof and two arms at the end of the torso adjacent said head.

10. The doll of claim 8 wherein said means comprises a cam means for moving said legs relative to the torso in a predetermined sequence of movement.

11. The doll of claim 10 wherein said cam means includes at least two cams, one associated with each of said legs for moving each leg in a predetermined sequence.

12. The doll of claim 11 wherein each of said cams each include a cam surface causing one of said legs to pivot relative to the torso portion prior to pivoting of said second leg.

13. The doll of claim 12 including drive means for simultaneously rotating said cam means.

14. The doll of claim 3 including switch means movable between a first and second position, said means being connected to said switch means for permitting moving of said doll to said sitting position when said switch means is in a first position and for permitting moving of said doll to said standing position when said switch is in said second position.

15. The doll of claim 14 wherein said torso portion includes a head movably mounted on the top thereof, said head being connected to said switch means to permit selective movement of said switch means between said first and second position by movement of said head between a first and second position.

* * * * *